US010753197B2

(12) United States Patent
Themig

(10) Patent No.: US 10,753,197 B2
(45) Date of Patent: Aug. 25, 2020

(54) METHOD AND SYSTEM FOR MONITORING WELL OPERATIONS

(71) Applicant: PACKERS PLUS ENERGY SERVICES INC., Calgary (CA)

(72) Inventor: Daniel Jon Themig, Calgary (CA)

( * ) Notice: Subject to any disclaimer, the term of this patent is extended or adjusted under 35 U.S.C. 154(b) by 814 days.

(21) Appl. No.: 14/399,831

(22) PCT Filed: May 7, 2013

(86) PCT No.: PCT/CA2013/050354
§ 371 (c)(1),
(2) Date: Nov. 7, 2014

(87) PCT Pub. No.: WO2013/166602
PCT Pub. Date: Nov. 14, 2013

(65) Prior Publication Data

US 2015/0107829 A1 Apr. 23, 2015

Related U.S. Application Data

(60) Provisional application No. 61/643,735, filed on May 7, 2012.

(51) Int. Cl.
*E21B 47/095* (2012.01)
*E21B 47/107* (2012.01)
(Continued)

(52) U.S. Cl.
CPC ..... *E21B 47/091* (2013.01); *E21B 34/14* (2013.01); *E21B 47/101* (2013.01); *E21B 2034/007* (2013.01)

(58) Field of Classification Search
CPC ..... E21B 47/00; E21B 47/14; E21B 47/16; E21B 47/091
See application file for complete search history.

(56) References Cited

U.S. PATENT DOCUMENTS 4,066,994 A 1/1978 Patchett et al.
4,660,638 A 4/1987 Yates
(Continued)

FOREIGN PATENT DOCUMENTS

CA 2751473 A1 * 8/2010 ..... E21B 23/00
CA 2751473 A1 8/2010
(Continued)

OTHER PUBLICATIONS

European Search Report for European Patent Application No. 13788341.9, dated Sep. 29, 2016, 10 pgs.
(Continued)

*Primary Examiner* — Robert E Fuller

(57) ABSTRACT

A method for monitoring well operations comprises sensing oscillations occurring in the well during a well operation and generating a signal indicative of the oscillations. The signal is processed into sensed data indicative of the oscillations sensed in the well, and the sensed data is then compared with reference data associated with previously detected well operations, to identify the well operation that generated the sensed oscillations. The system that performs the well monitoring, comprises one or more transducers configured to sense the oscillations, and a processing system in communication with the transducer which identifies the well operation and the device that caused the oscillations, based on comparisons of data indicative of the oscillations, with reference data associated with previously detected well operations.

18 Claims, 16 Drawing Sheets

(51) Int. Cl.

| | |
|---|---|
| ***E21B 47/09*** | (2012.01) |
| *E21B 34/00* | (2006.01) |
| *E21B 34/14* | (2006.01) |
| *E21B 47/10* | (2012.01) |

(56) References Cited

U.S. PATENT DOCUMENTS

| | | | | |
|---|---|---|---|---|
| 5,148,408 | A | 9/1992 | Matthews | |
| 6,386,285 | B1 | 5/2002 | Heijnen | |
| 6,924,745 | B2 | 8/2005 | Schultz et al. | |
| 6,994,162 | B2 | 2/2006 | Robison | |
| 7,819,188 | B2 | 10/2010 | Auzerais et al. | |
| 9,103,203 | B2 | 8/2015 | Miller et al. | |
| 2004/0105342 | A1 | 6/2004 | Gardner | |
| 2004/0140092 | A1* | 7/2004 | Robison | E21B 29/02 166/255.1 |
| 2004/0159428 | A1 | 8/2004 | Hammond et al. | |
| 2007/0215345 | A1 | 9/2007 | Lafferty et al. | |
| 2011/0030947 | A1* | 2/2011 | Schreiber | E21B 33/138 166/250.01 |
| 2011/0122727 | A1 | 5/2011 | Gleitman et al. | |
| 2011/0139445 | A1 | 6/2011 | Fripp et al. | |
| 2011/0240364 | A1 | 10/2011 | Catoi | |
| 2012/0051186 | A1 | 3/2012 | Holley | |
| 2012/0111560 | A1 | 5/2012 | Hill et al. | |
| 2013/0105221 | A1* | 5/2013 | Wassell | E21B 44/00 175/40 |
| 2013/0255940 | A1* | 10/2013 | Rochford | E21B 47/00 166/255.2 |

FOREIGN PATENT DOCUMENTS

| | | | | | |
|---|---|---|---|---|---|
| GB | 2398869 | A * | 9/2004 | | E21B 29/02 |
| GB | 2398869 | A | 9/2004 | | |
| WO | WO 2012/003419 | A2 | 1/2012 | | |
| WO | WO-2012003419 | A2 * | 1/2012 | | E21B 34/14 |

OTHER PUBLICATIONS

International Search Report for International Patent Application No. PCT/CA2013/050354, dated Aug. 5, 2013, 6 pgs.

International Preliminary Report on Patentability and Written Opinion for International Patent Application No. PCT/CA2013/050354, dated Nov. 11, 2014, 9 pgs.

European Search Report for European Patent Application No. 13788341.9, dated Jun. 13, 2016, 5 pgs.

* cited by examiner

100a
X
Y
Z 102
200
102
100b
14b
104
20a
12
14
10
17
100a
102
21a
21b
20b
16b
20c
16c
20d
16d
20e
16e
29
20f
14a
28

METHOD AND SYSTEM FOR MONITORING WELL OPERATIONS

FIELD OF THE INVENTION

The invention relates to a method and system for monitoring downhole events in a wellbore and, in particular, to a method and system for monitoring the movement of downhole objects, including the actuation of wellbore devices.

BACKGROUND OF THE INVENTION

Some wellbore devices are actuated at selected times, when they are downhole. They are actuated to perform a function such as setting, sealing, opening and closing. While the actuation of the wellbore device may be critical for proper wellbore operations, the devices are often deep in the ground and their condition cannot be readily ascertained.

One example wellbore device includes a hydraulic piston for example, such as a sliding sleeve mechanism. Wellbore fluid treatments may be conveyed through tubing strings that have one or more sliding sleeve mechanisms to control the setting operation of packers and/or to control the open/closed conditions of fluid treatment ports. If a sliding sleeve mechanism fails to be properly actuated, the wellbore process can be jeopardized. Sometimes, a ball or plug is dropped downhole to interact with or perhaps actuate wellbore devices. Information on the movement and location of the ball or plug may be useful in some wellbore operations.

In some operations, pressure monitoring is used to monitor hydraulic actuations. However, pressure monitoring is not always accurate.

SUMMARY OF THE INVENTION

A method and system has been invented which allows well conditions to be monitored.

In accordance with a broad aspect of the present invention, there is provided a method for monitoring a well operation comprising: receiving signals arising from oscillation propagations from the well to generate acceleration data; and processing the acceleration data to indicate a well condition.

In accordance with another broad aspect of the present invention, there is provided a method for fracturing a hydrocarbon-containing formation accessible through a wellbore, the method comprising: running a tubing string into the wellbore, the tubing string having a long axis and an inner bore and comprising: a first port opened through the tubing string wall; a first sliding sleeve positioned relative to the first port and moveable relative to the first port between (i) a closed port position wherein fluid can pass the seat and flow downhole of the first sliding sleeve and (ii) an open port position permitting fluid flow through the first port from the tubing string inner bore and sealing against fluid flow past the seat and downhole of the first sliding sleeve; moving the sliding sleeve to the open port position permitting fluid flow through the first port; monitoring the vibrations arising from the well to confirm a well condition; and pumping fracturing fluid through the port and into an annular wellbore segment to fracture the hydrocarbon-containing formation.

In accordance with another broad aspect of the present invention, there is provided a well monitoring system comprising: a sensing system configured to sense vibrations arising from well operations, collect acceleration data of a well condition and generate a signal to an operator, the sensing system including a transducer and a processing system in communication with the transducer.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE PRESENT INVENTION

Figures 1A, 1C:
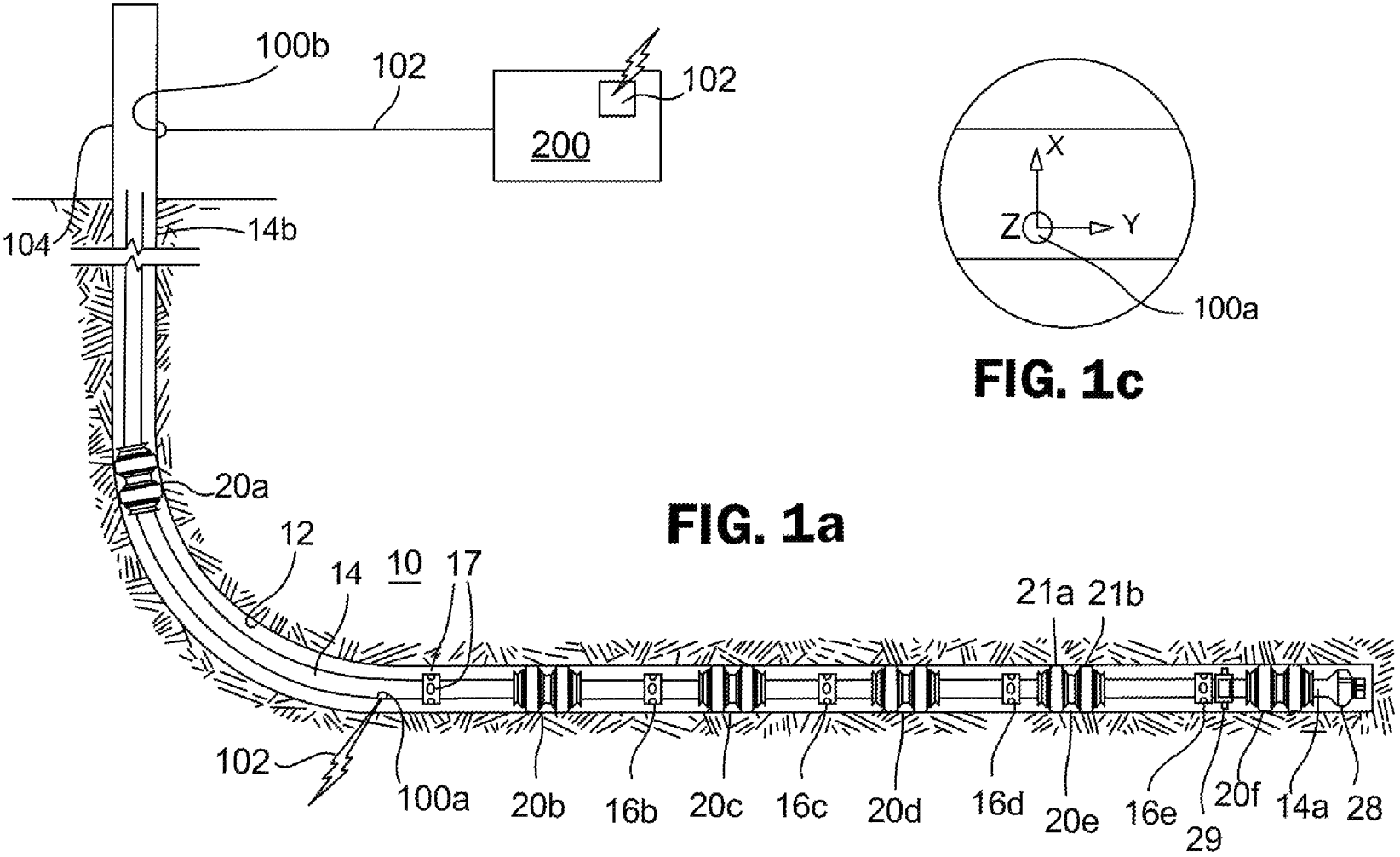
FIG. 1*a* is a sectional view through a wellbore having positioned therein a fluid treatment assembly according to the present invention.
FIG. 1*c* is an enlarged view of a portion of a tubing string in circle "A" of FIG. 1*a;*
Figure 1B:
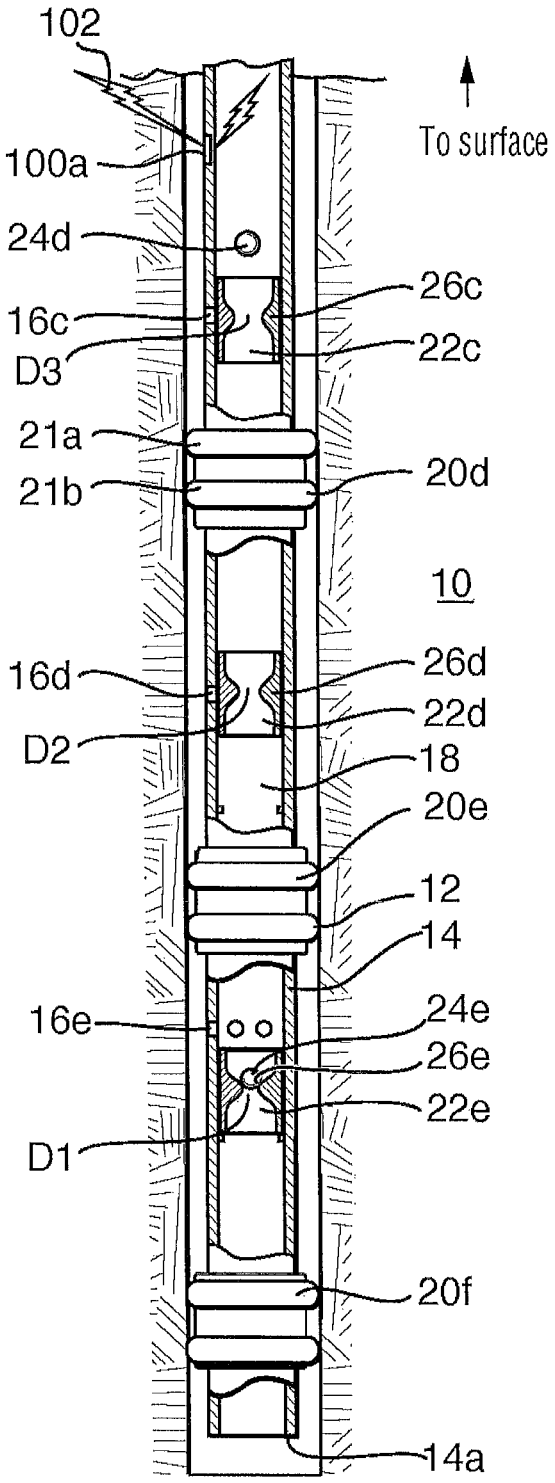
FIG. 1*b* is an enlarged view of a portion of the wellbore of FIG. 1*a* with the fluid treatment assembly also shown in section.

Referring to FIGS. 1*a* and 1*b*, a wellbore fluid treatment assembly is shown, which can be used to effect fluid treatment of a formation 10 through a wellbore 12. The wellbore assembly includes a tubing string 14 having a lower end 14*a* and an upper end extending to surface 14*b*. A wellbore fluid treatment assembly as shown can include various downhole tools with mechanisms such as fluid treatment subs, packers, valves, circulation valves, etc. These mechanisms are actuated to provide a function such as setting, sealing, opening and closing.

For example, tubing string 14 includes a plurality of spaced apart ported intervals 16*a* to 16*e* each including a plurality of ports 17 opened through the tubing string wall to permit access between the tubing string inner bore 18 and the wellbore. The open and closed condition of the ports in each interval is controlled by a sliding sleeve mechanism.

A packer 20*a* is mounted between the upper-most ported interval 16*a* and the surface and further packers 20*b* to 20*e* are mounted between each pair of adjacent ported intervals.

In the illustrated embodiment, a packer 20*f* is also mounted below the lower most ported interval 16*e* and lower end 14*a* of the tubing string. The packers are disposed about the tubing string and selected to seal the annulus between the tubing string and the wellbore wall, when the assembly is disposed in the wellbore. The packers divide the wellbore into isolated segments wherein fluid can be applied to one segment of the well, but is prevented from passing through the annulus into adjacent segments. As will be appreciated the packers can be spaced in any way relative to the ported intervals to achieve a desired interval length or number of ported intervals per segment. In addition, packer 20*f* need not be present in some applications.

The packers are of the solid body-type with at least one extrudable packing element, for example, formed of rubber. Solid body packers including multiple, spaced apart packing elements 21*a*, 21*b* on a single packer are particularly useful especially for example in open hole (unlined wellbore) operations. In another embodiment, a plurality of packers are positioned in side by side relation on the tubing string, rather than using one packer between each ported interval. Each packer is hydraulically operated and includes a hydraulic piston that can be actuated by increasing pressure beyond the holding strength of shear stock holding the piston in place.

Sliding sleeves 22*c* to 22*e* are disposed in the tubing string to control the opening of the ports. In this embodiment, a sliding sleeve is mounted over each ported interval to close them against fluid flow therethrough, but can be moved away from their positions covering the ports to open the ports and allow fluid flow therethrough. In particular, the sliding sleeves are disposed to control the opening of the ported intervals through the tubing string and are each moveable from a closed port position covering its associated ported interval (as shown by sleeves 22*c* and 22*d*) to a position away from the ports wherein fluid flow of for example, stimulation fluid is permitted through the ports of the ported interval (as shown by sleeve 22*e*).

The assembly is run in and positioned downhole with the sliding sleeves each in their closed port position. The sleeves are moved to their open position when the tubing string is ready for use in fluid treatment of the wellbore. Preferably, the sleeves for each isolated interval between adjacent packers are opened individually to permit fluid flow to one wellbore segment at a time, in a staged, concentrated treatment process.

Preferably, the sliding sleeves are each moveable remotely from their closed port position to their position permitting through-port fluid flow, for example, without having to run in a line or string for manipulation thereof. In one embodiment, the sliding sleeves are each actuated by a device, such as a ball 24*e* (as shown) or other forms of plugs, which can be conveyed by gravity or fluid flow through the tubing string. The device engages against the sleeve, in this case ball 24*e* engages against sleeve 22*e*, and, when pressure is applied through the tubing string inner bore 18 from surface, ball 24*e* seats against and creates a pressure differential above and below the sleeve which drives the sleeve toward the lower pressure side.

In the illustrated embodiment in FIG. 1*b*, the inner surface of each sleeve which is open to the inner bore of the tubing string defines a seat 26*e* onto which an associated ball 24*e*, when launched from surface, can land and seal thereagainst. When the ball seals against the sleeve seat and pressure is applied or increased from surface, a pressure differential is set up which causes the sliding sleeve on which the ball has landed to slide to a port-open position. When the ports of the ported interval 16*e* are opened, fluid can flow therethrough to the annulus between the tubing string and the wellbore and thereafter into contact with formation 10.

Each of the plurality of sliding sleeves has a different diameter seat and therefore each accept different sized balls. In particular, the lower-most sliding sleeve 22*e* has the smallest diameter D1 seat and accepts the smallest sized ball 24*e* and each sleeve that is progressively closer to surface has a larger seat. For example, as shown in FIG. 1*b*, the sleeve 22*c* includes a seat 26*c* having a diameter D3, sleeve 22*d* includes a seat 26*d* having a diameter D2, which is less than D3 and sleeve 22*e* includes a seat 26*e* having a diameter D1, which is less than D2. This provides that the lowest sleeve can be actuated to open first by first launching the smallest ball 24*e*, which can pass though all of the seats of the sleeves closer to surface but which will land in and seal against seat 26*e* of sleeve 22*e*. Likewise, penultimate sleeve 22*d* can be actuated to move away from ported interval 16*d* by launching a ball 24*d* which is sized to pass through all of the seats closer to surface, including seat 26*c*, but which will land in and seal against seat 26*d*.

Lower end 14*a* of the tubing string can be open, closed or fitted in various ways, depending on the operational characteristics of the tubing string which are desired. In the illustrated embodiment, includes a toe valve 28 which may be a circulation valve, a pump out plug assembly, etc. A pump out plug assembly acts, for example, to close off end 14*a* during run in of the tubing string, to maintain the inner bore of the tubing string relatively clear. However, by application of fluid pressure, for example at a pressure of about 3000 psi, the plug can be blown out to permit actuation of the lower most sleeve 22*e* by generation of a pressure differential. A circulation valve allows circulation through the string but can later be closed by for example plugging a conduit, shifting a sleeve mechanism, etc. As will be appreciated, an opening adjacent end 14*a* is only needed for circulation and/or where pressure, as opposed to gravity, is needed to convey the first ball to land in the lower-most sleeve. Alternately, the lower most sleeve can be hydraulically actuated, including a fluid actuated piston, such as a sliding sleeve secured by shear pins, so that the sleeve can be opened remotely without the need to land a ball or plug therein.

In other embodiments, not shown, end 14*a* can be left open or can be closed for example by installation of a welded or threaded plug.

While the illustrated tubing string includes five ported intervals, it is to be understood that any number of ported intervals could be used. In a fluid treatment assembly desired to be used for staged fluid treatment, at least two openable ports from the tubing string inner bore to the wellbore must be provided such as at least two ported intervals or an openable end and one ported interval. It is also to be understood that any number of ports can be used in each interval.

Centralizer 29 and other standard tubing string attachments can be used.

In use, the wellbore fluid treatment apparatus, as described with respect to FIGS. 1*a* and 1*b*, can be used in the fluid treatment of a wellbore. For selectively treating formation 10 through wellbore 12, the above-described assembly is run into the borehole and the packers are set to seal the annulus at each location creating a plurality of isolated annulus zones. Fluids can then be pumped down the tubing string and into a selected zone of the annulus, such as by increasing the pressure to pump out plug assembly 28. Alternately, a plurality of open ports or an open end can be provided or lowermost sleeve can be hydraulically openable. Once that selected zone is treated, as desired, ball 24*e* or another sealing plug is launched from surface and conveyed by gravity or fluid pressure to seal against seat 26*e* of the lower most sliding sleeve 22*e*, this seals off the tubing string below sleeve 22*e* and opens ported interval 16*e* to allow the next annulus zone, the zone between packer 20*e* and 20*f* to be treated with fluid. The treating fluids will be diverted through the ports of interval 16*e* exposed by moving the sliding sleeve and be directed to a specific area of the formation. Ball 24*e* is sized to pass though all of the seats, including 26*c*, 26*d* closer to surface without sealing thereagainst. When the fluid treatment through ports 16*e* is complete, a ball 24*d* is launched, which is sized to pass through all of the seats, including seat 26*c* closer to surface, and to seat in and move sleeve 22*d*. This opens ported interval 16*d* and permits fluid treatment of the annulus between packers 20*d* and 20*e*. This process of launching progressively larger balls or plugs is repeated until all of the zones are treated. The balls can be launched without stopping the flow of treating fluids. After treatment, fluids can be shut in or flowed back immediately. Once fluid pressure is reduced from surface, any balls seated in sleeve seats can be unseated by pressure from below to permit fluid flow upwardly therethrough.

The apparatus is particularly useful for stimulation of a formation, using stimulation fluids, such as for example, acid, gelled acid, gelled water, gelled oil, $CO_2$, nitrogen and/or proppant laden fluids.

Figure 2A:
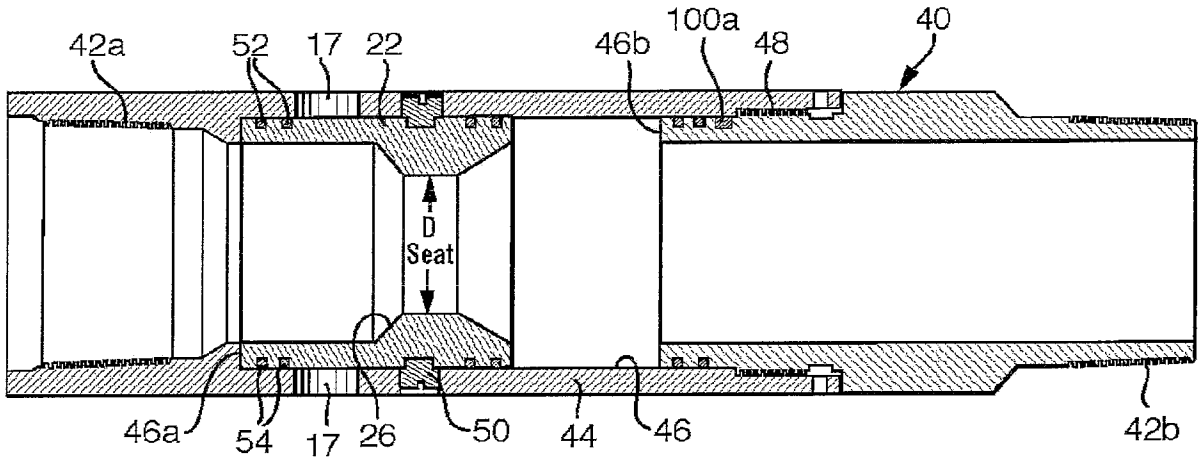
FIG. 2*a* is a sectional view along the long axis of a tubing string sub useful in the present invention containing a sleeve in a closed port position.
Figure 2B:
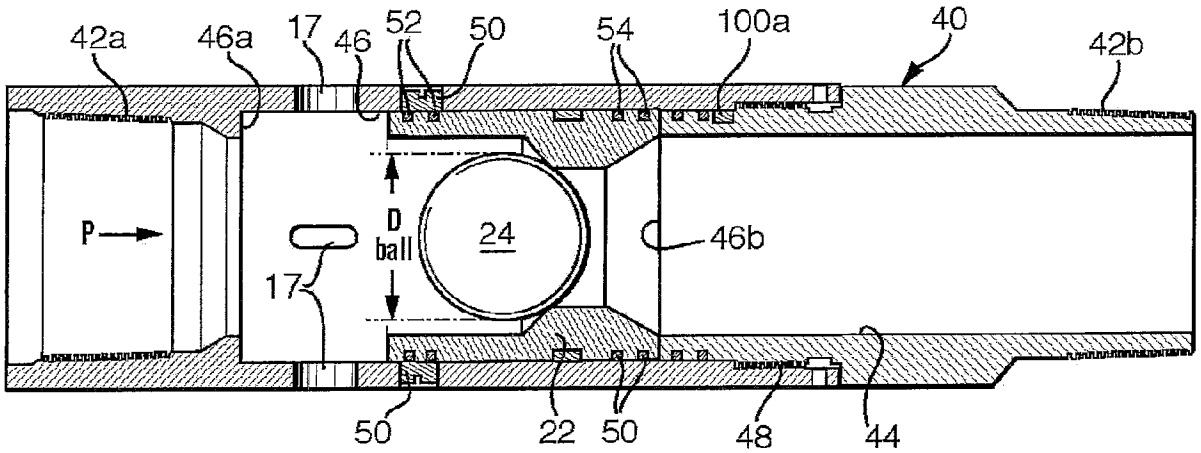
FIG. 2*b* is a sectional view along the long axis of the tubing string sub of FIG. 2*a* in a position allowing fluid flow through fluid treatment ports.

Referring to FIGS. 2*a* and 2*b*, a tubing string sub 40 is shown having a sleeve 22, positionable over a plurality of ports 17 to close them against fluid flow therethrough and moveable to a position, as shown in FIG. 2*b*, wherein the ports are open and fluid can flow therethrough.

The sub 40 includes threaded ends 42*a*, 42*b* for connection into a tubing string. Sub 40 includes a wall 44 having formed on its inner surface a cylindrical groove 46 for retaining sleeve 22. Shoulders 46*a*, 46*b* define the ends of the groove 46 and limit the range of movement of the sleeve. Shoulders 46*a*, 46*b* can be formed in any way as by casting, milling, etc. the wall material of the sub or by threading parts together, as at connection 48. The tubing string is preferably formed to hold pressure. Therefore, any connection should, in the preferred embodiment, be selected to be substantially pressure tight.

In the closed port position, sleeve 22 is positioned adjacent shoulder 46*a* and over ports 17. Shear pins 50 are secured between wall 44 and sleeve 22 to hold the sleeve in this position. A ball 24 is used to shear pins 50 and to move the sleeve to the port-open position. In particular, the inner facing surface of sleeve 22 defines a seat 26 having a diameter Dseat, and ball 24, is sized, having a diameter Dball, to engage and seal against seat 26. When pressure is applied, as shown by arrows P, against ball 24, shears 50 will release allowing sleeve 22 to be driven against shoulder 46*b*. The length of the sleeve is selected with consideration as to the distance between shoulder 46*b* and ports 17 to permit the ports to be open, to some degree, when the sleeve is driven against shoulder 46*b*.

Preferably, the tubing string is resistant to fluid flow (i) outwardly therefrom except through open ports and (ii) downwardly past a sleeve in which a ball is seated. Thus, ball 24 is selected to seal in seat 26 and seals 52, such as o-rings, are disposed in glands 54 on the outer surface of the sleeve, so that fluid bypass between the sleeve and wall 44 is substantially prevented.

Ball 24 can be formed of ceramics, steel, plastics or other durable materials and is preferably formed to seal against its seat.

When sub 40 is used in series with other subs, any subs in the tubing string below sub 40 have seats selected to accept balls having diameters less than Dseat and any subs in the tubing string above sub 40 have seats with diameters greater than the ball diameter Dball useful with seat 26 of sub 40.

Figure 2C:
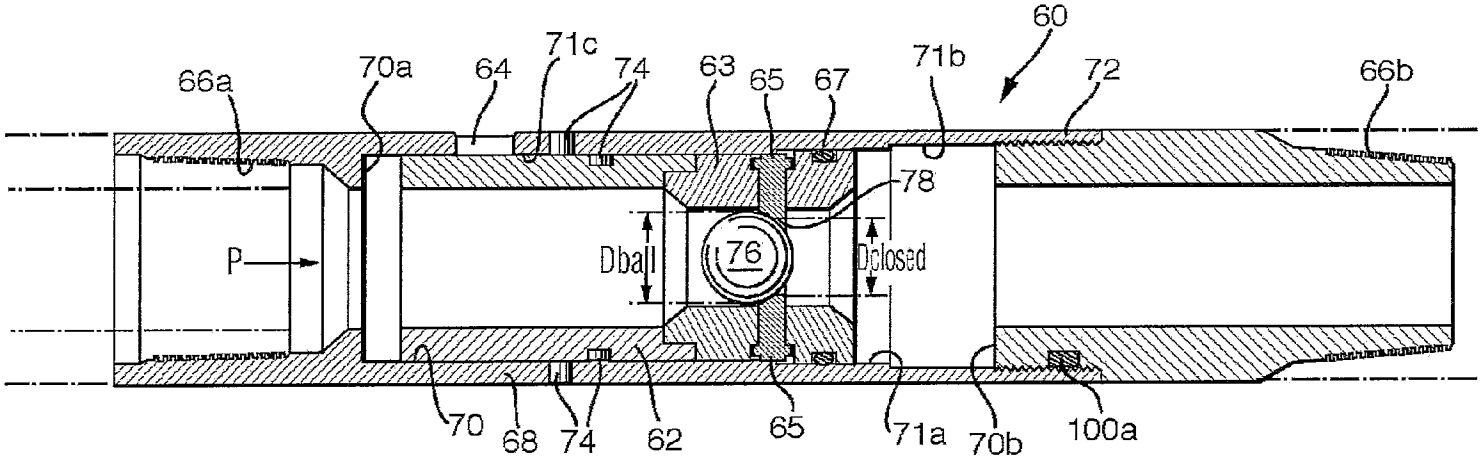
FIG. 2*c* is a sectional view along the long axis of another tubing string sub useful in the present invention containing a sleeve in a closed port position.
Figure 2D:
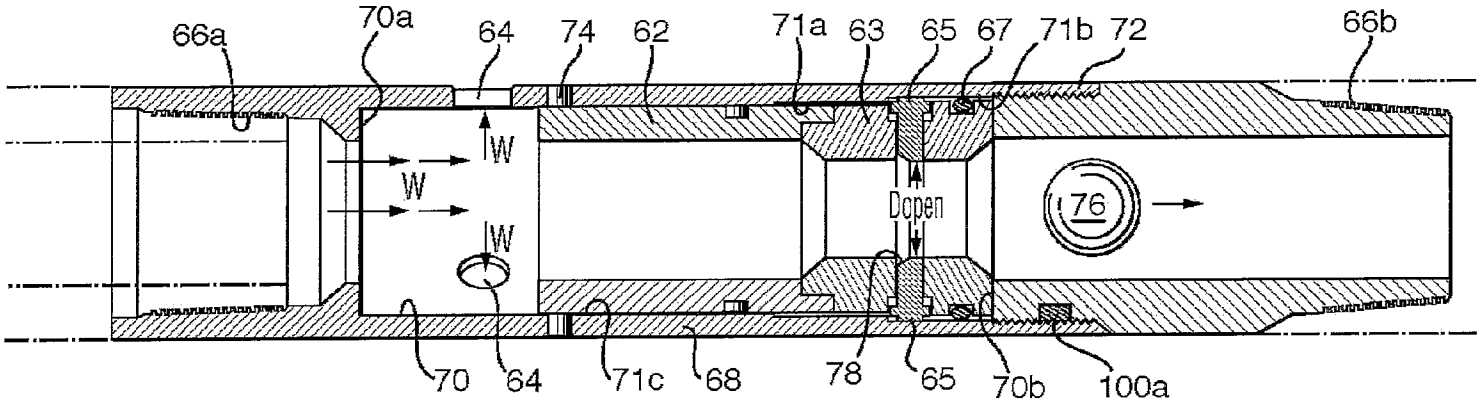
FIG. 2*d* is a sectional view along the long axis of the tubing string sub of FIG. 2*c* in a position allowing fluid flow through fluid treatment ports.

In an alternative or additional embodiment, the wellbore fluid treatment apparatus includes one or more pass-through subs 60. The pass-through sub may be used in combination with sub 40 and may be connected in series with sub 40 in the tubing string. Referring to FIGS. 2*c* and 2*d*, the pass-through tubing string sub 60 is shown having a sleeve 62, positionable over a plurality of ports 64 to close them against fluid flow therethrough and moveable to a position, as shown in FIG. 2*d*, wherein the ports are open and fluid can flow therethrough.

The sleeve 62 includes a key retainer 63 and a spring 67. Compressible keys 65 are provided in key retainer 63. The sub 60 includes threaded ends 66*a*, 66*b* for connection into a tubing string. Sub 60 includes a wall 68 having formed on its inner surface a cylindrical groove 70 for retaining sleeve 62. Shoulders 70*a*, 70*b* define the ends of the groove 70 and limit the range of movement of the sleeve 62. Shoulders 70*a*, 70*b* can be formed in any way as by casting, milling, etc. the wall material of the sub or by threading parts together, as at connection 72. The inner facing surface of groove 70 further includes a first recess 71*a* and a second recess 71*b*, wherein the inner diameter of second recess 71*b* is greater than that of first recess 71*a* and the inner diameter of first recess 71*a* is greater than the inner diameter of the remaining surface 71*c* of groove 70. The second recess 71*b* is adjacent to shoulder 70*b*, while the first recess 71*a* is in between surface 71*c* and the second recess 71*b*.

In the closed port position, sleeve 62 is positioned adjacent shoulder 70*a* and over ports 64. Shear pins 74 are secured between wall 68 and sleeve 62 to hold the sleeve in this position. A ball 76 is used to create a piston-effect across sleeves 62 to create a force to shear pins 74 and to move the sleeve to the port-open position. In particular, the inner facing surfaces of keys 65 of key retainer 63 define a seat 78. Seat 78 has a diameter Dclosed, and ball 76, is sized, having a diameter Dball, to engage and seal against seat 78. The outer facing surfaces of keys 65 engage the surface 71*c* of groove 70, which may be a result of the ball 76 pushing on the seat 78 and/or the keys 65 being spring-biased to extend radially outwardly. The outer facing surface of the sleeve 62 is biased against the first recess 71*a* by spring 67. When pressure is applied, as shown by arrows P, against ball 76, shears 74 will release allowing sleeve 62 to be driven against shoulder 70*b*, and allowing keys 65 to shift radially and spring 67 to extend outwardly to engage the second recess 71*b*. The length of the sleeve 62 is selected with consideration as to the distance between shoulder 70*b* and ports 64 to permit the ports to be open, to some degree, when the sleeve is driven against shoulder 70*b*, to allow fluid inside the sub 60 to exit (as indicated by arrows W). When pass-through sub 60 is in the port-open position, keys 65 have been shifted to engage with the second recess 71*b*, causing seat 78 to have a new diameter, Dopen, which is greater than Dclosed and Dball. As such, ball 76 can pass through sleeve 62 and continue down the tubing string when the pass-through sub 60 is in the port-open position.

Seals, such as o-rings, may be included in sub 60 to substantially fluid seal the interfaces between the various parts of the sub. Ball 76 can be formed of ceramics, steel, plastics or other durable materials.

As mentioned above, pass-through sub 60 may be used in conjunction with sub 40 in the wellbore fluid treatment assembly. In one embodiment, pass-through sub 60 is connected in series above sub 40 in the tubing string. The ball diameter Dball is selected so that it is greater than Dclosed but smaller than Dopen, to allow the ball to actuate sub 60 and then pass through sub 60, and greater than Dseat, to allow the ball to be received by seat 26 in order to actuate sub 40.

When a wellbore device is actuated, oscillations are generated and propagated by the release of energy. As will be appreciated, the term oscillation propagations include the interchangeable terms: acoustic, sonic, sound, noise, vibration, and acceleration.

Oscillations are propagated by device actuations including setting or releasing a packer, opening or closing a valve such as a fluid treatment port, circulation valve. Device actuations that result in the release of energy, and thereby an oscillation propagation, include for example one or more of shearing of shear pins, the movement of a sliding sleeve, the impact of a sliding sleeve against a stop shoulder, and interaction of ratchet teeth.

For example, when a packer 20 sets, it requires a force that ranges from 25,000 to 50,000 lbs. This action breaks shear pins, which makes a noise. Some packers are set by hydraulic or mechanical manipulations through a tubing string on which they are mounted and others may be set by manipulations through the annulus, such as for example a no-port packer (i.e. which has no communication port through the tubing string to the packing element). Regardless of the mode of actuation, setting of the packer may generate oscillations.

As another example, the opening of a sliding sleeve valve as illustrated in FIG. 2, requires a force of at least 25,000 lbs. Both the shearing of shear pins 50, 74 and the impact of sleeve 22, 62 hitting stop shoulder 46*b*, 70*b* generates noises.

Oscillations are also propagated by movement of an actuation device (ball or other form of plug) through a tubing string or a tool therein. Movements that result in the release of energy, and thereby an oscillation propagation, including for example one or more of (i) affecting fluid flow as a result of the actuation device moving through a flow path and/or (ii) physical contact with a conduit, including on-surface piping, ball launchers, elbows, tubing string, constrictions, etc. For example, propagations occur when the actuation device passes through the ball launcher, other surface equipment, through the tubing string, and through downhole tools. These oscillations can be employed to confirm movement of the actuation device and/or determine the speed, velocity or location of the actuation device.

Oscillations are also propagated by fluid pumping effects, such as changes in pumping rates, fluid pressure, etc.

A sensing system can be employed to monitor indicators, such as vibrations or pressure changes, of the well condition and to generate a signal to an operator. The sensing system may include a transducer 100*a* and/or 100*b* and a processing system 200. Various types of transducers may be used, including electroacoustic, electromechanical, etc., depending on the type of indicator to be monitored. The transducer may include for example, an accelerometer, a pressure transducer, a microphone, etc.

In one embodiment, the transducer is an accelerometer which can be installed in various locations, provided it is capable of sensing the vibration generated by actuation of the tool and provided it can operate with the processing system. The accelerometer may be piezoelectric, piezoresistive, or capacitive. The accelerometer should be of suitable construction for withstanding conditions downhole and/or at the wellhead. In one embodiment, the vibration data collected by the accelerometer can be played back as sound through speakers.

The accelerometer 100*a*, for example, can be installed downhole in or adjacent the tool to be actuated. The accelerometer can measure acceleration in one or more directions. In a sample embodiment, the accelerometer can be oriented as shown in FIG. 1*c*, such that the accelerometer measures acceleration in one or more axes X, Y, Z, wherein the Y axis is substantially parallel to the central long axis of the tubing string, and the X and Z axes extend radially outwards from the Y axis. The X and Z axes are substantially orthogonal to the Y axis and to each other. The accelerometer can then communicate with the processing system by a wired or wireless communication system 102.

However, it is noted that the generated vibration can be sensed along the pipe of the liner in which the devices are installed, such as along the material of tubing string 14. The devices will be connected into the string, as by the threading of subs into the string such that the vibration can travel by means of the string itself or through adjacent wellbore structures, such as a production string or surface casing. In one embodiment, for example, the accelerometer 100*b* can be installed at a surface location where it is easier to link to the processing system, but is connected to a structure which receives oscillation energy from downhole.

The vibrations of the actuation of the wellbore devices will eventually reach surface and can be measured by utilizing an accelerometer. Accelerometer 100*b* can be installed in vibration communication with the string through which the vibration is being conveyed to surface. For example, the accelerometer can be installed to pick up vibrations conveyed through the tubing to the wellhead apparatus 104 to record the acceleration. In one embodiment, the accelerometer is placed in contact with the wellhead apparatus. The wellhead apparatus is the structure rising up out of the wellbore and exposed on surface 103. In one embodiment, the wellhead apparatus includes, as shown, a tree, including pipes, surface connections to pumping lines 108, etc. The accelerometer is placed in contact with the tree or pumping lines.

In one embodiment, at least one surface accelerometer 100*b* and/or at least one downhole accelerometer 100*a* is employed. The accelerometers can work together or in redundancy to record the vibration emissions from the downhole tools. The accelerometer can be mounted, preferably on a substantially planar surface of a downhole tool or wellhead, using a variety of methods including by fastener, magnet, clamp, adhesives, bonding, etc.

The processing system 200 can be employed to receive and process the vibration picked up at the accelerometer. The systems can include for example, receivers, recorders, filters, software, signal generators, communication devices, etc. In one embodiment, a filter, for example, via computer software is employed to filter ambient noise, such as of the surface pumps or other vibrations typical in wellbore operations. The system can record the vibrations remaining after filtering to identify the remaining vibrations. In one embodiment, a signal generator can generate a signal in real-time.

Once the action of actuating the downhole tool is recorded, the software can "recognize" the vibration as indicative of the tool operation and provide the operator with a signal to provide the reassurance that the tool has actuated.

The system can be preloaded, for example, programmed, with reference vibration signals and/or patterns such that the vibration signal received at the processing system can be positively identified. In one embodiment, for example, reference vibration signals can be obtained for specific tool actuations. The reference vibration signal can be associated with a downhole tool actuation for a general tool actuation, for various specific tools, or for the discreet actuation components (i.e. failure of shear pins vs. the sleeve hitting against a stop shoulder) for any particular tool. The reference vibration signals can be entered to the processing system such that the signal generated to the operator can be even more accurate or provide more information.

As such, vibration signals generated from acceleration data can provide a positive indication that one or more downhole tools have actuated.

Acceleration data can be employed alone or with another indicator, including for example pressure data. For example, if pressure in the string is being monitored, pressure signals or patterns can be sensed indicating when a hydraulic operation has been conducted. For example, when a ball opens sleeve 22, this may be sensed by pressure monitoring systems and be identifiable. If the data is gathered properly and the pressure gauge can "see" the pattern properly it can be verified.

Figure 3:
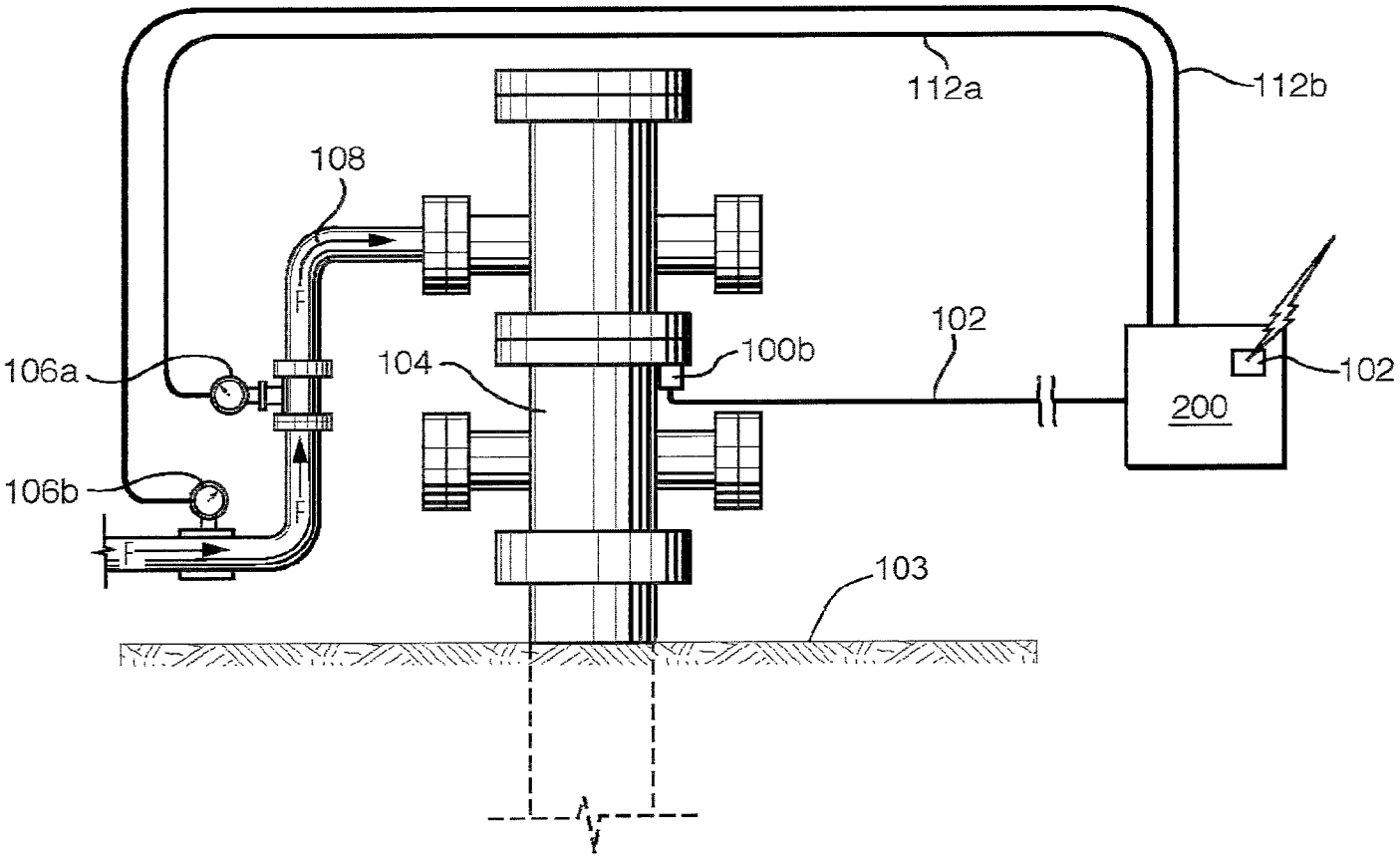
FIG. 3 is an enlarged view of the wellhead in FIG. 1*a* showing a setup according to one embodiment of the invention.

Referring to FIG. 3, additional transducers 106*a* and/or 106*b* may be included at the wellhead for gathering corroboration or backup data. In one embodiment, transducers 106*a* and 106*b* measure fluid pressure and generate pressure signals. In one embodiment, transducers 106*a* and 106*b* are piezoresistive strain gauge devices. Of course, other types of transducers and transducers that generate other types of data may be also used. Transducers 106*a* and 106*b* should have a relatively high overload and burst pressure and should be of a sufficiently robust construction for use at a well site and/or downhole. One or more transducers 106*a* and 106*b* may be installed along the length of a fluid supply conduit 108 to wellhead apparatus 104. The direction of fluid flow in conduit 108 is indicated by arrows F. Transducers 106*a* and 106*b* can then communicate with the processing system by a wired or wireless communication system 112*a* and 112*b*. In one embodiment, the wellhead has multiple conduits, with one or more transducers installed thereon.

Operators can make use of a real-time feedback provided by the system. For example, a method for monitoring a well condition can include receiving vibration signals arising from well oscillation propagations to generate acceleration data and processing the acceleration data; and generating a signal to an operator indicating a well condition such as that a downhole tool has been actuated.

The method may further include any one or more of filtering the data, receiving signals from at least one of a downhole transducer or a surface transducer, correlating the data with fluid pressure signals, etc.

The method may be employed in wellbore fluid treatments to detect certain events, including setting and/or releasing packers (including no-port packers), opening fluid treatment ports, closing circulation valves, opening valves. The method may also be employed to detect movement and/or ascertain the location of an actuation device in a tubing string.

For example, as a ball is released into a flow stream, either via the wellhead or via a pumping line, the movement of the ball generates vibrations that are detectable by a transducer. Analyzing the acceleration signals from the transducer, and possibly comparing the signals with vibration signatures from past known events, can help determine when the ball has exited the pumping line or wellhead and confirm that the ball is in motion.

Movement of the ball into or through a tubing string structure such as a tool, for example, one including a constriction, may generate vibrations that are detectable by a transducer. Again, analyzing the acceleration signals from the transducer, and possibly comparing the signals with vibration signatures from past known events, can help determine when the ball has arrived at or passed the tubing string structure and confirm that the ball is in motion.

It may be possible to determine the approximate speed, velocity, and location of the ball leaving, moving away from the wellhead or downhole at a given time, based on changes and/or patterns in the acceleration signal. For example, as the ball moves further away from the wellhead, the vibration detected from the ball rattling against or rolling down the tubing string changes at a certain rate depending on the velocity of the ball and the location of the transducer. The vibration signature may increase or decrease depending on whether the ball is moving toward or away from, respectively, the transducer. The change in vibration signature can provide an indication of the location and direction of travel of the ball at a given time, which helps determine when the ball is approaching a landing seat or a specific point along the length of the well.

Alternately or additionally, it may be possible to determine the approximate speed and velocity of the ball downhole by comparing acceleration signals against time and the known spacing of surface structures and tubing string structures.

Where two or more transducers are employed, the speed of the transmission of the vibratory signal may be employed to define aspects of the movement of an actuation device (i.e. a form of triangulation). For example, by using transducers 100*a* and 100*b*, the rate of movement and location of an actuation device along string 14 may be determined by analysis of the time that a vibratory signal generated by movement of the actuation device through the string arrives at each transducer. This may be enhanced by employing transducers that are offset from the tubing string axis.

Sonic filters and signatures may be useful in separating useful vibration signatures from any background noise. Algorithms may be applied to filtered vibration signatures to help pinpoint the location of the ball within a predetermined margin of error, perhaps in relation to a downhole tool that requires activation by the ball.

The speed/velocity and/or location information of the ball obtained from vibration signals is useful in determining whether the ball is stuck in a certain part of the well such that it is prevented from reaching a particular destination (e.g. a tool that requires activation). The speed/velocity and/or location information of the ball may also be useful in determining whether the fluid flow rate within the casing needs to be reduced in order to minimize the impact by the ball on a ball seat and/or to maintain the impact force within an acceptable range, such that downhole tools are not exposed to excessive forces that are outside the range for which the tools are designed.

Figure 5A:
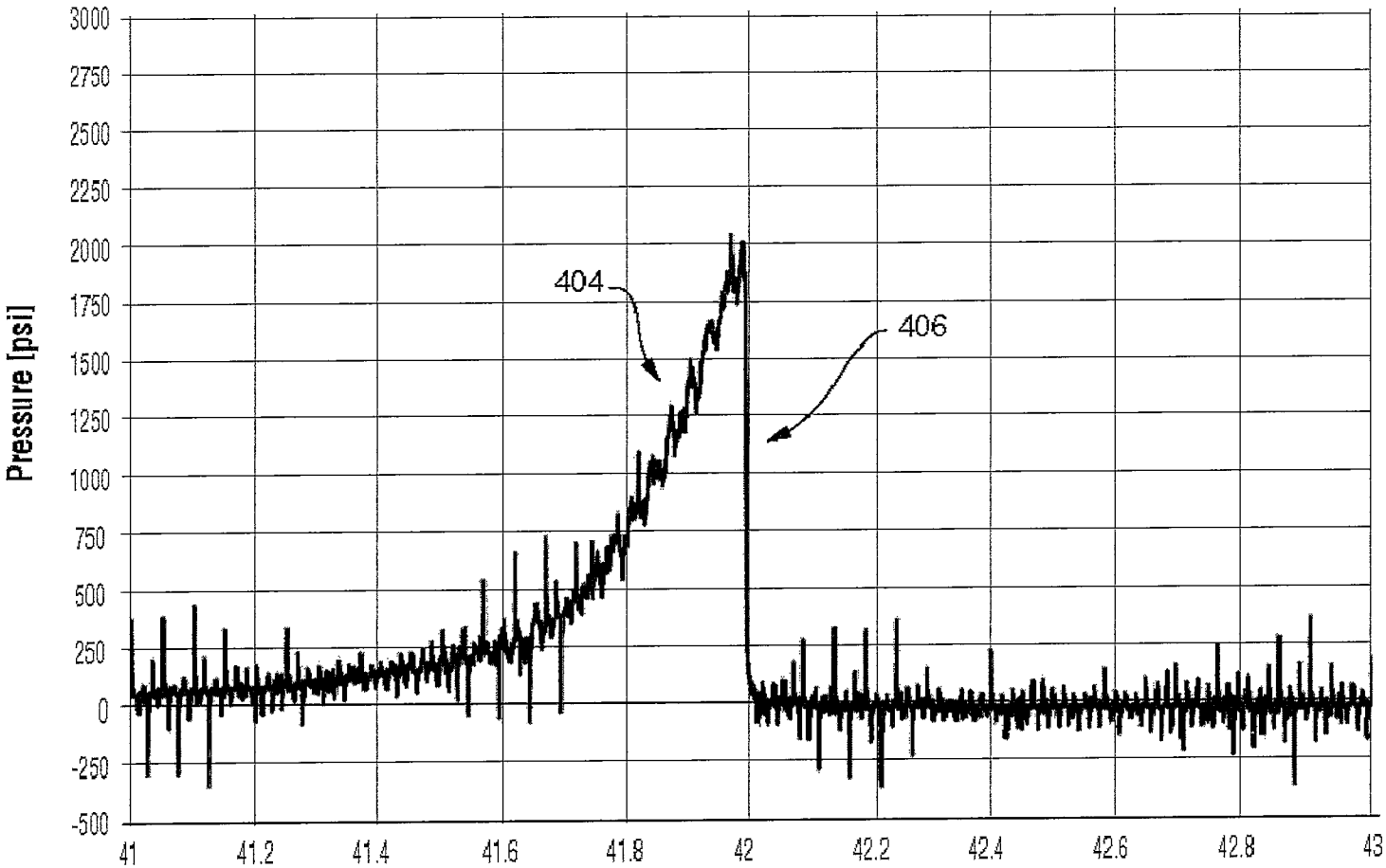
FIGS. 5*a* to 5*c* are graphical representations of a portion of the data in FIGS. 4*a* to 4*f;*
Figure 5B:
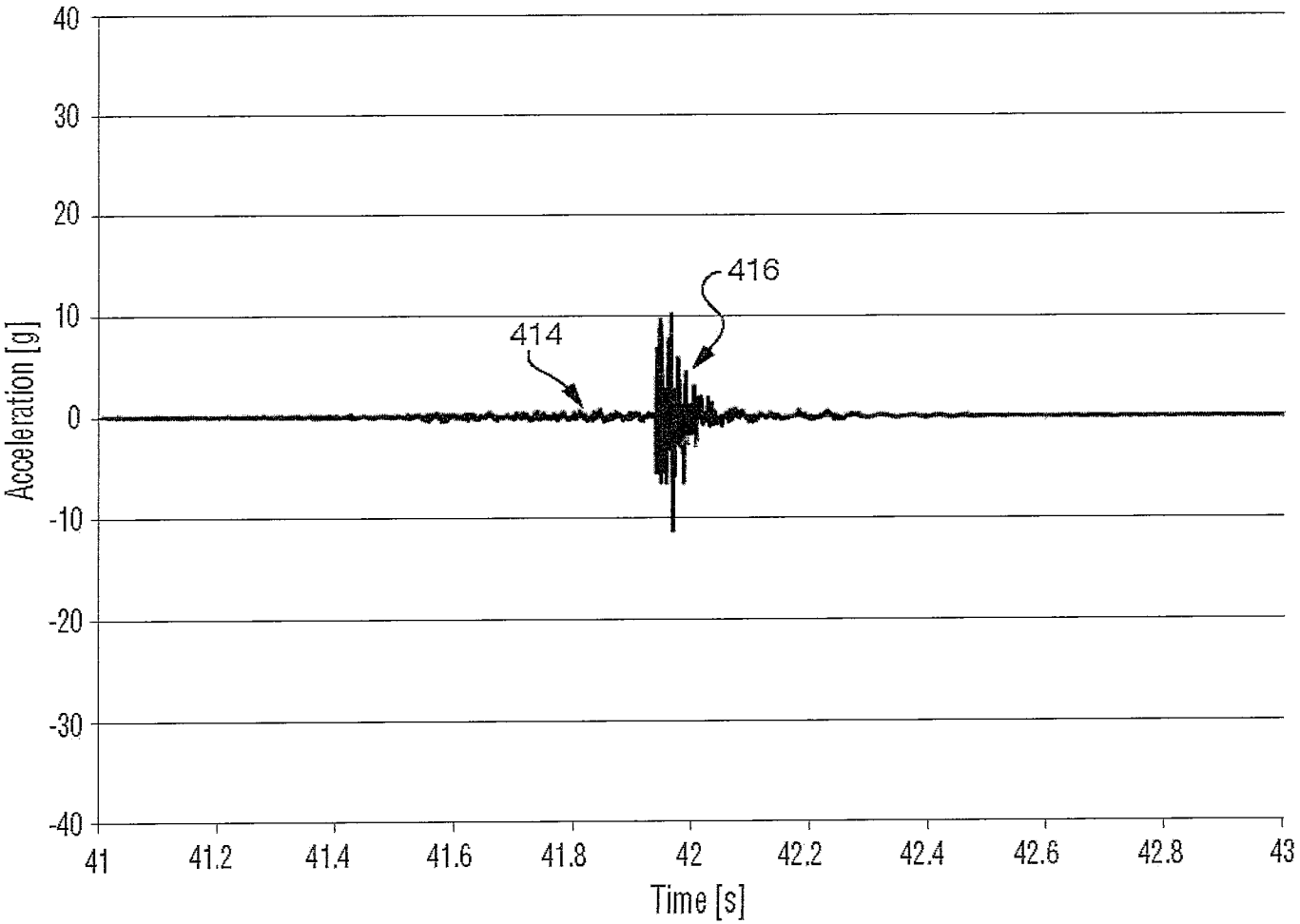
Figure 5C:
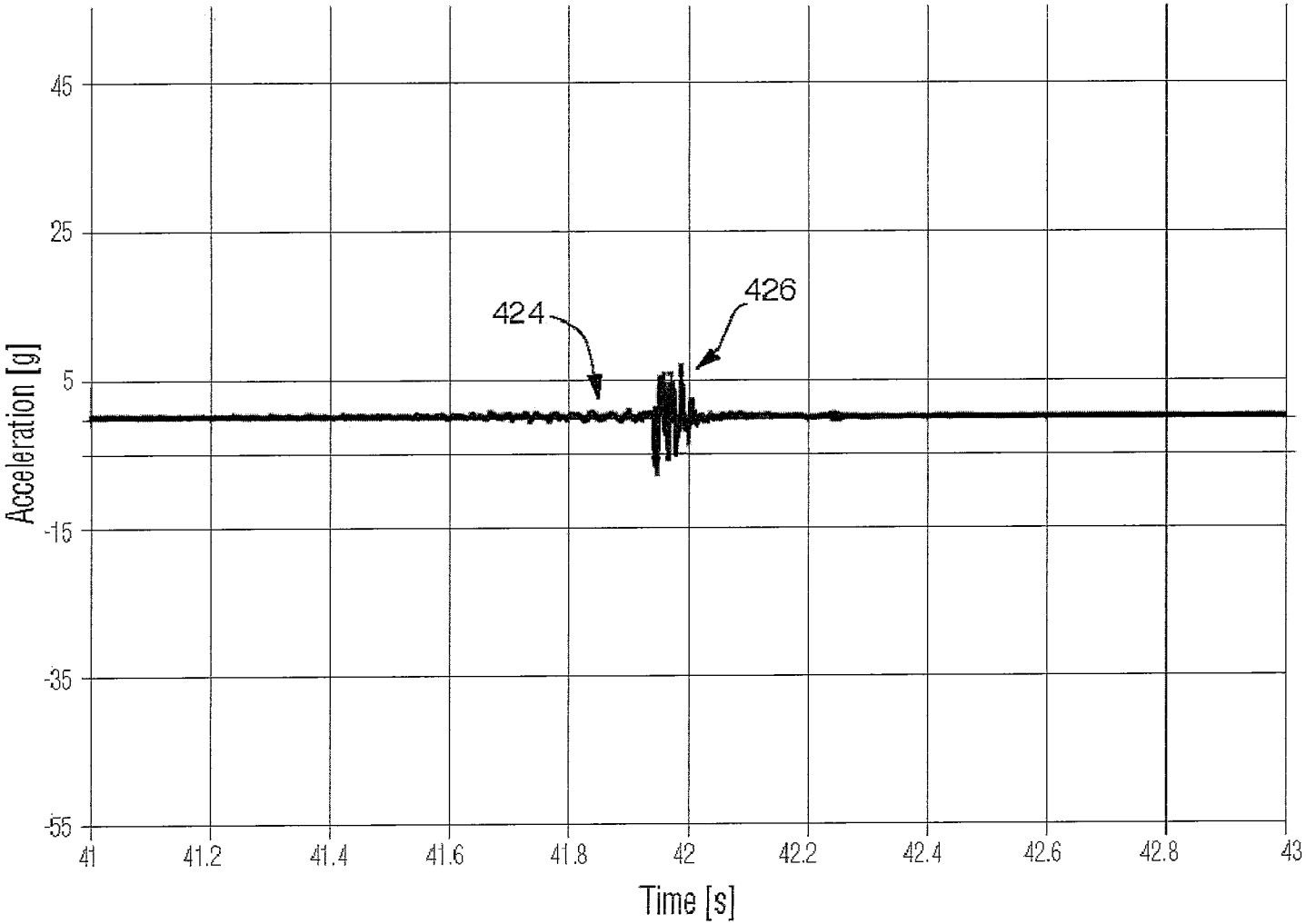
Figure 6:
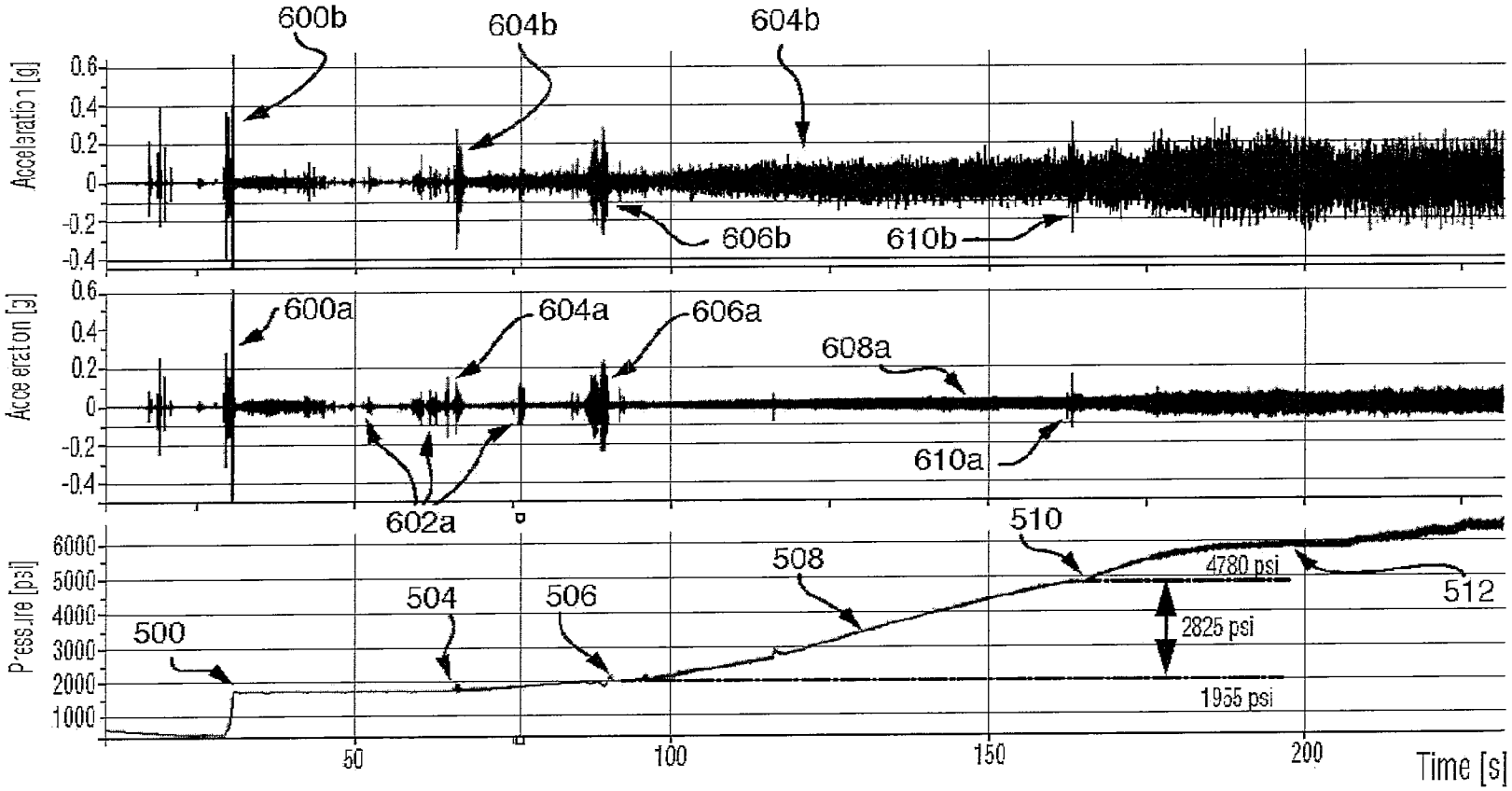
FIG. 6 are graphical representations of sample data collected from a field test.
Figure 7:
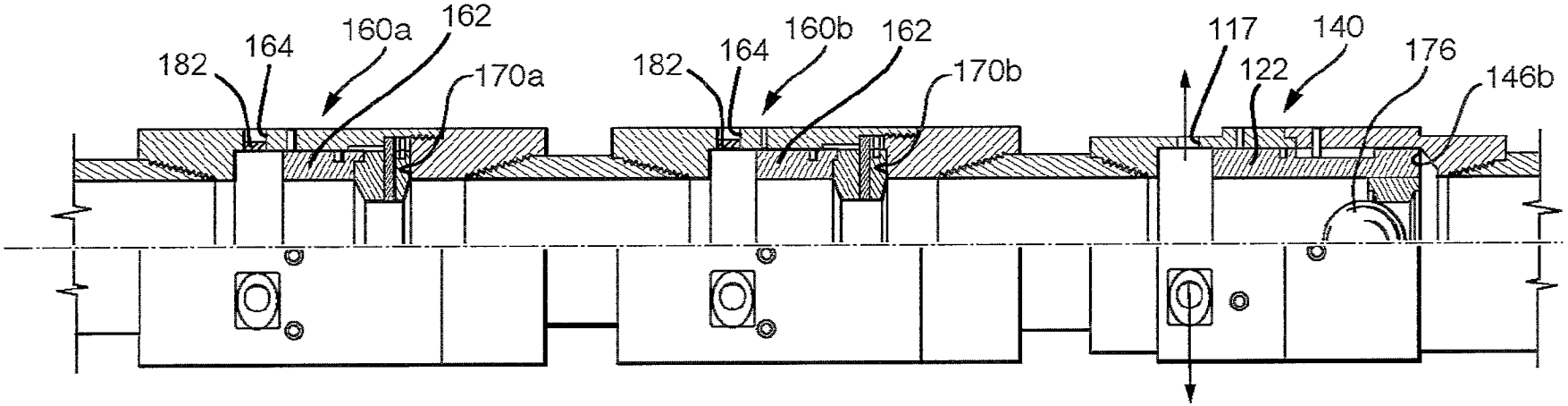
FIG. 7 is a partial cross-sectional view of a portion of a laboratory test assembly.
Figure 8:
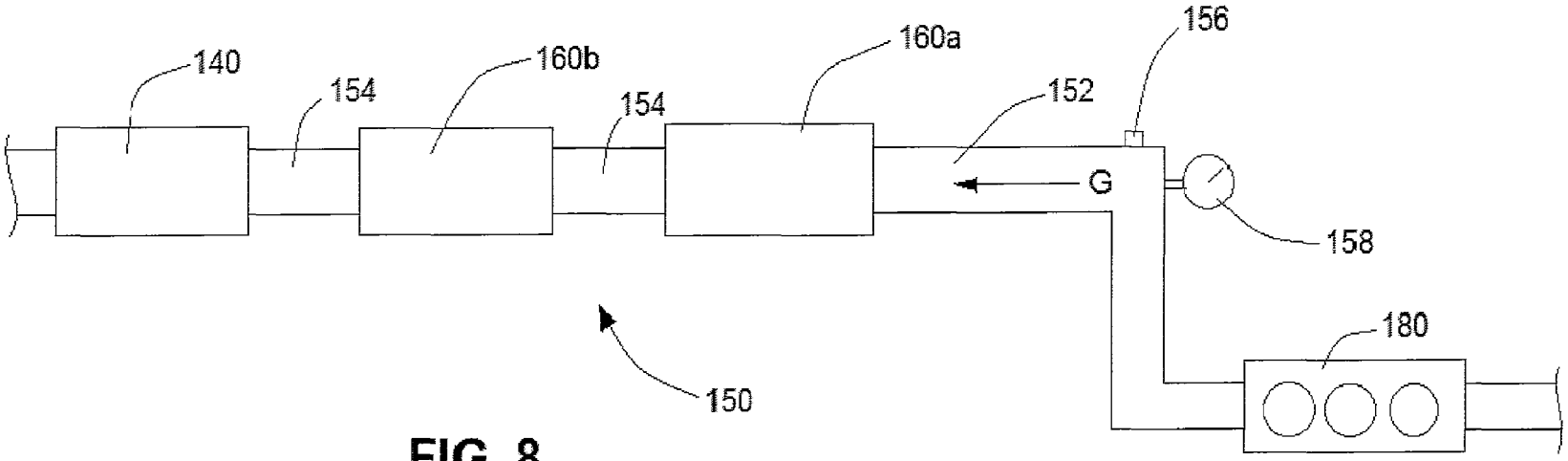
FIG. 8 is a schematic view of a portion of the laboratory test assembly.

Laboratory and in field simulations were carried out to obtain the sample data provided in FIGS. 4 to 6.

Referring to FIGS. 4, 5, 7 and 8, a lab test assembly 150 comprising a tubing having two pass-through subs and one sub connected in series was used in a laboratory setting to collect pressure and vibration data on the various stages of actuating the assembly.

The lab test assembly 150 had a first pass-through sub 160*a*, a second pass-through sub 160*b*, and a sub 140, all of which were connected in series in an in-line flow loop 152. Adjacent subs were connected by 4½, 11.6# casing 154 and were spaced apart by about 20'. The lab test assembly operated aboveground. More specifically, the casing was anchored to a substantially horizontal aboveground test rail (not shown) with nylon ratchet straps. A triaxial integrated circuit piezoelectric (ICP) accelerometer 156 and a piezoresistive strain transducer 158 were mounted in line with the casing, in between sub 160*a* and a triplex pump 180, and positioned approximately 15' from sub 160*a*. Sub 140 was furthest away from the triplex pump, the accelerometer and the transducer, and sub 160*b* was placed between subs 160*a* and 140. Subs 160*a* and 160*b* were equipped with sleeves 162 that covered ports 164. Ports 164 were plugged with blank jets 182 to ensure that when the sleeve exposed the ports, tubing pressure was not lost and sufficient pressure is maintained to continue testing operations. Sub 140 included a sleeve 122 that covered ports 117. Pressure signals generated by the transducer and acceleration signals generated by the accelerometer were recorded with a data acquisition system consisting of analog current and voltage modules, pressure and acceleration power supplies and a computer with USB connection to the data acquisition system. Water was pumped into the lab test assembly 150 by the pump 180 at a flow rate of approximately 100 fluid gallons per minute. A ball 176 having a diameter of approximately 3" was dropped into the test assembly and was used to set all three subs in succession.

The graphs shown in FIGS. 4 and 5 are plots of the data collected during the laboratory test, without any filtering or correction for background noise. FIG. 4*a* is a plot of the pressure signal in the test assembly over time. Ball 176 was dropped into the test assembly and water was pumped in direction G down the assembly. As the ball rolled towards the first pass-through sub 160*a*, the pressure in the assembly remained substantially constant. At around the 30 s mark, the ball came into contact with the seat of sub 106*a*. As the ball nudged tighter on to the seat of sub 160*a*, fluid flow through the sub 160*a* was increasingly constricted and fluid pressure above (i.e. upstream of) the ball increased 400*a*, as shown between 30 s and just before the 32 s mark. When the fluid pressure differential was sufficient to cause the sliding sleeve on which the ball had landed to slide to the open-port position, a sharp pressure drop 402*a* was detected almost immediately thereafter, indicating the passage of the ball through the seat. As the ball continued to roll towards the second pass-through sub 160*b*, the pressure signal remained substantially constant (between 32 s and 35 s). The ball then encountered the seat of the second pass-through sub 160*b*, and as the ball became more tightly seated in the seat of sub 160*b*, fluid pressure in the assembly increased 400*b* (between 36 s and immediately before 38 s) until the sleeve of sub 160*b* was pushed into the open-port position and almost immediately thereafter a second sharp pressure drop 402*b* was detected. Sub 160*b* was of the same construction as sub 160*a* so the pressure rise and fall pattern of sub 160*b* was similar to that of sub 160*a*. After the ball passed through sub 160*b* and before encountering the seat of sub 140, the pressure was substantially constant (between 38 s and just after 41 s). The pressure rose 404 between 41 s and 42 s, when the ball was pushed more and more tightly against the seat of sub 140. When the sleeve of sub 140 slid to the port-open position at around 42 s, a sharp pressure drop 406 was detected almost immediately thereafter. Since sub 140 is of a different configuration, for example having a shear rating lower, than subs 160*a* and 160*b*, the pressure rise and fall pattern of sub 140 is different than those of subs 160*a* and 160*b*. More specifically, from the pressure signal, it can be seen that the shear pins holding the sleeves in subs 160*a* and 160*b* were selected to release at a higher pressure (i.e. approximately 2750 psi) than the shear pins holding the sleeve in sub 140 (i.e. approximately 2000 psi).

Figure 4A:
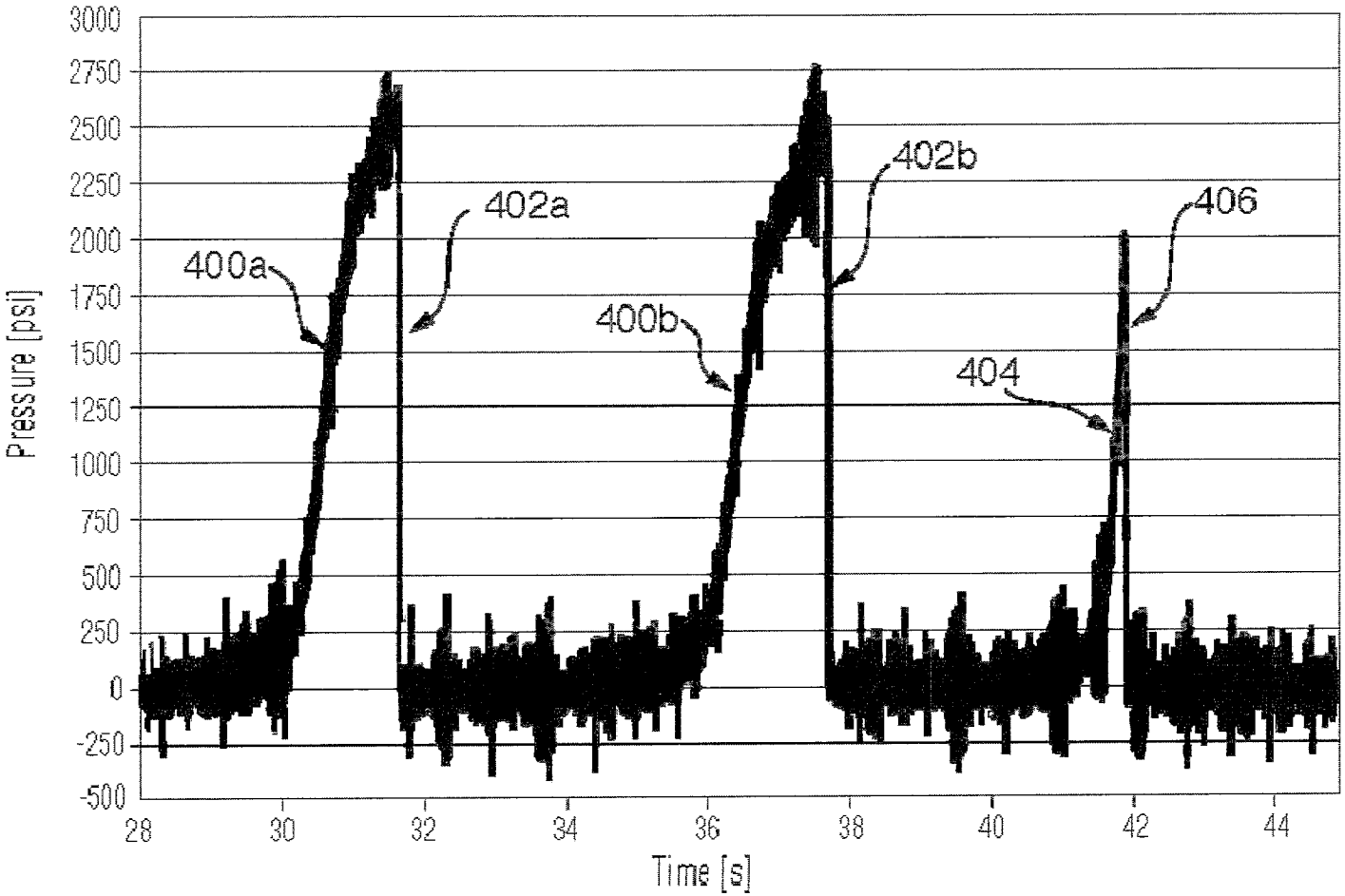
FIGS. 4*a* to 4*e* are graphical representations of sample data collected from a laboratory simulation.
Figure 4B:
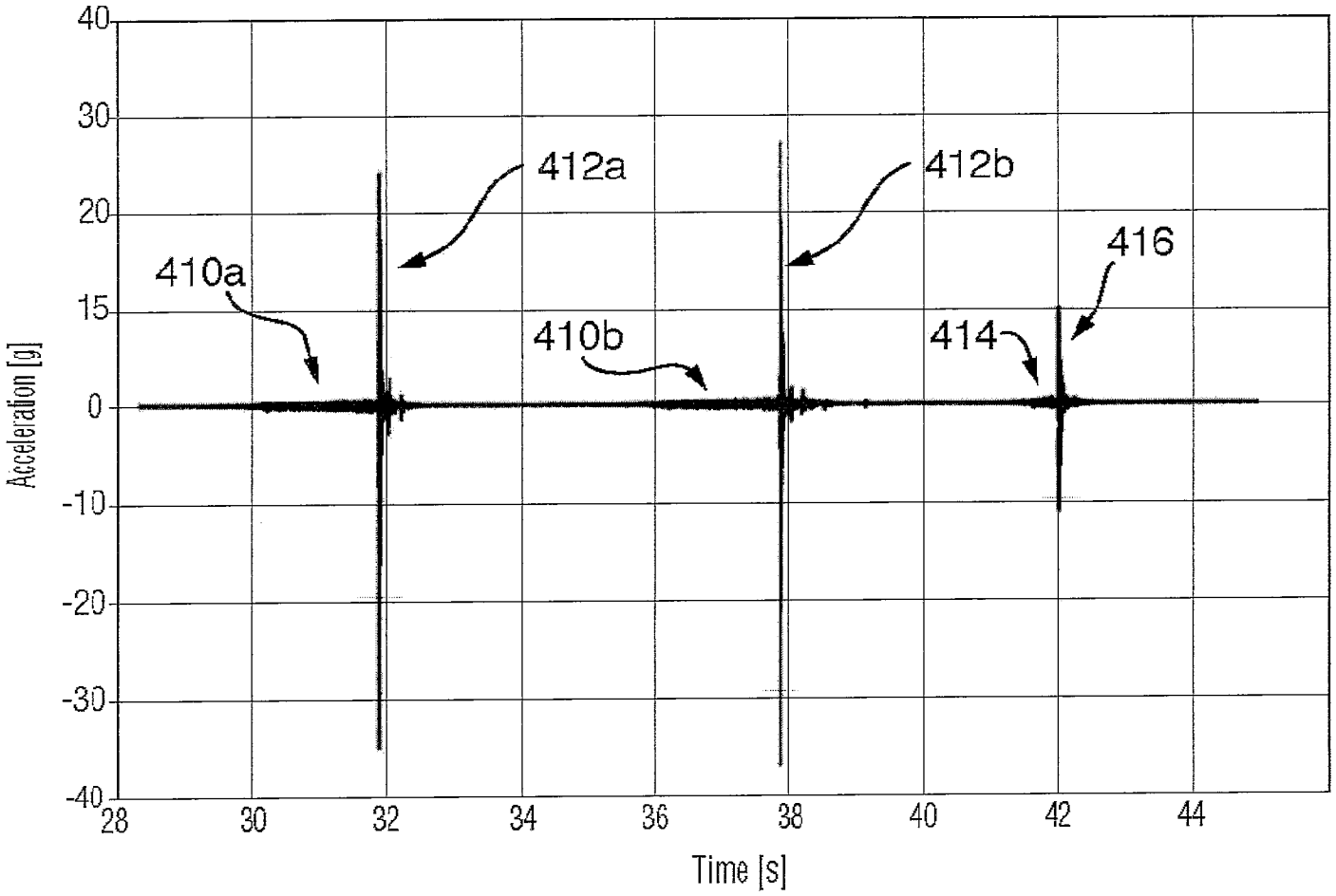
Figure 4C:
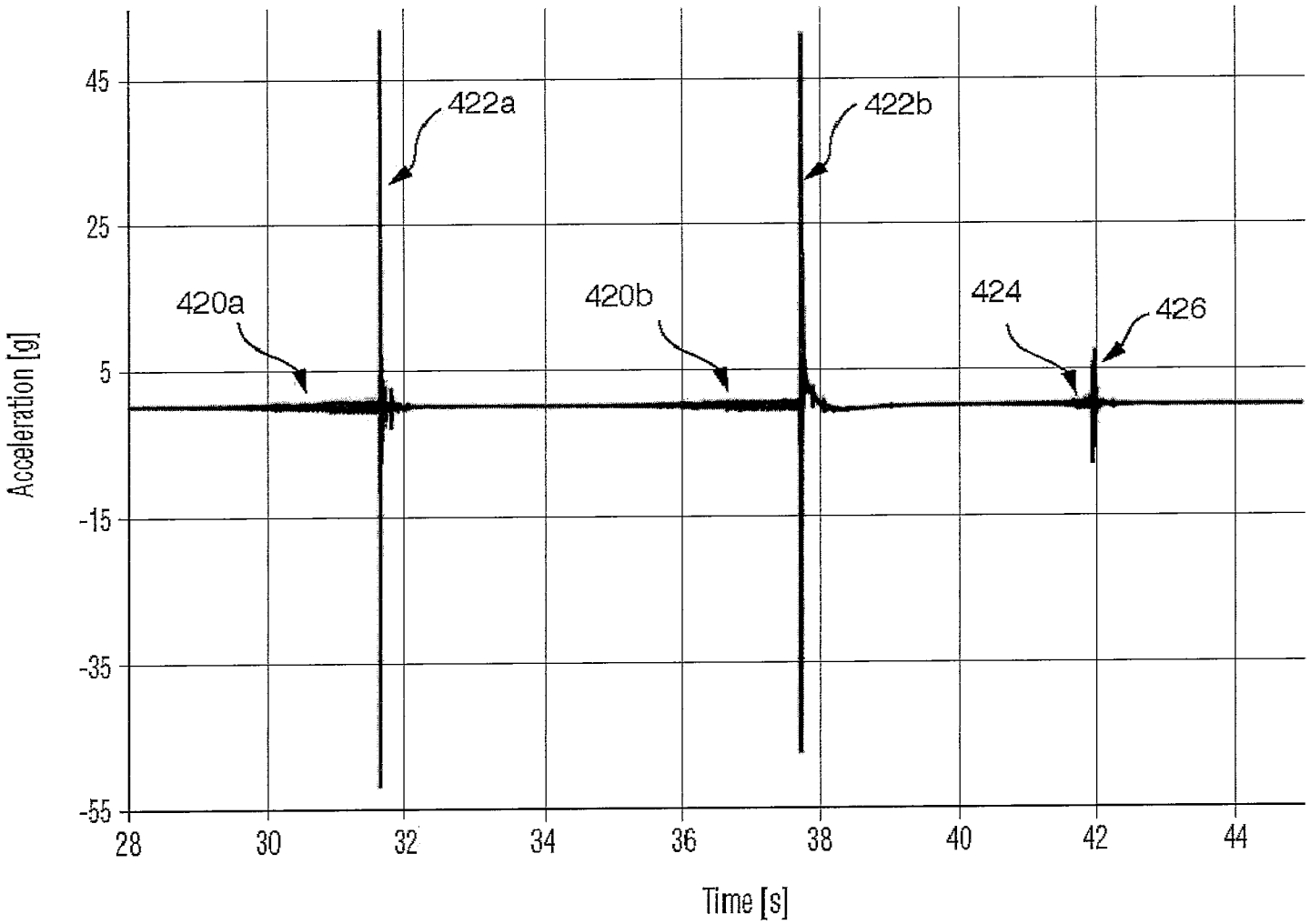

FIGS. 4*b* and 4*c* are plots of the vibration signal in g-force (g) detected and generated by the accelerometer over time in the test assembly, in the X and Z axes, respectively. Referring to both FIGS. 4*b* and 4*c*, the ball was dropped into the test assembly and almost no vibration was detected until the 30 s mark, when the ball encountered the seat of sub 160*a*. Between the 30 s and close to the 32 s mark, there was a substantially constant vibration signal 410*a*, 420*a*, indicating the ball's interaction with the seat as it was being pushed against it. When the sliding sleeve of 160*a* slid into the open-port position, its lower end slammed into a shoulder 170*a* and the impact generated a large amount of vibration, which was detected by the accelerometer and shown by a spike 412*a*, 422*a*. The impact generated accelerations having a magnitude ranging from about negative 36 g to positive 24 g in the x-axis direction, and from about negative 53 g to positive 52 g in the z-axis direction. After the impact, the vibration was quickly dampened and the vibration signal returned to approximately zero. After passing through sub 160*a*, the ball continued down the test assembly and as it came into contact and interacted with the seat of 160*b*, it generated a vibration signal 410*b*, 420*b*. The ball then pushed the sliding sleeve of 160*b* into the open-port position, where the sliding sleeve was stopped by a shoulder 170*b* and the collision between the sleeve and the shoulder generated a large amount of vibration, as indicated by a spike 412*b*, 422*b*. The accelerations generated by the collision had a magnitude ranging from about negative 38 g to positive 28 g in the x-axis direction and about negative 48 g to positive 51 g in the z-axis direction. After passing through sub 160*b*, the ball continued to roll down the test assembly toward sub 140. The interaction of the ball with the seat of sub 140 was indicated by a vibration signal 414, 424 between the 41 s mark and the 42 s mark. When the sliding sleeve of sub 140 slammed into a shoulder 146 it came into the port-open position, the impact was indicated by a vibration signal 416, 426. The magnitude of accelerations generated by the impact between the sliding sleeve and the shoulder of sub 140 ranged between about negative 11 g and positive 10 g in the x-axis direction and between about negative 8 g and positive 8 g in the z-axis direction. Since sub 140 was of a different construction than subs 160*a* and 160*b*, the vibration signal pattern and magnitude of sub 140 were different than those of subs 160*a* and 160*b*. More specifically, from the vibration signal, it appears that the actuation time of sub 140 was approximately half that of sub 160*a* or 160*b* and the acceleration magnitude of the vibration generated by the actuation of sub 140 was much lower than that of subs 160*a* or 160*b*. It is also noted that it took approximately 6 s for the ball to move from sub 160*a* to sub 160*b*, which is a distance of approximately 20', and thus the ball moved at a speed of approximately 3.33'/s.

Figure 4D:
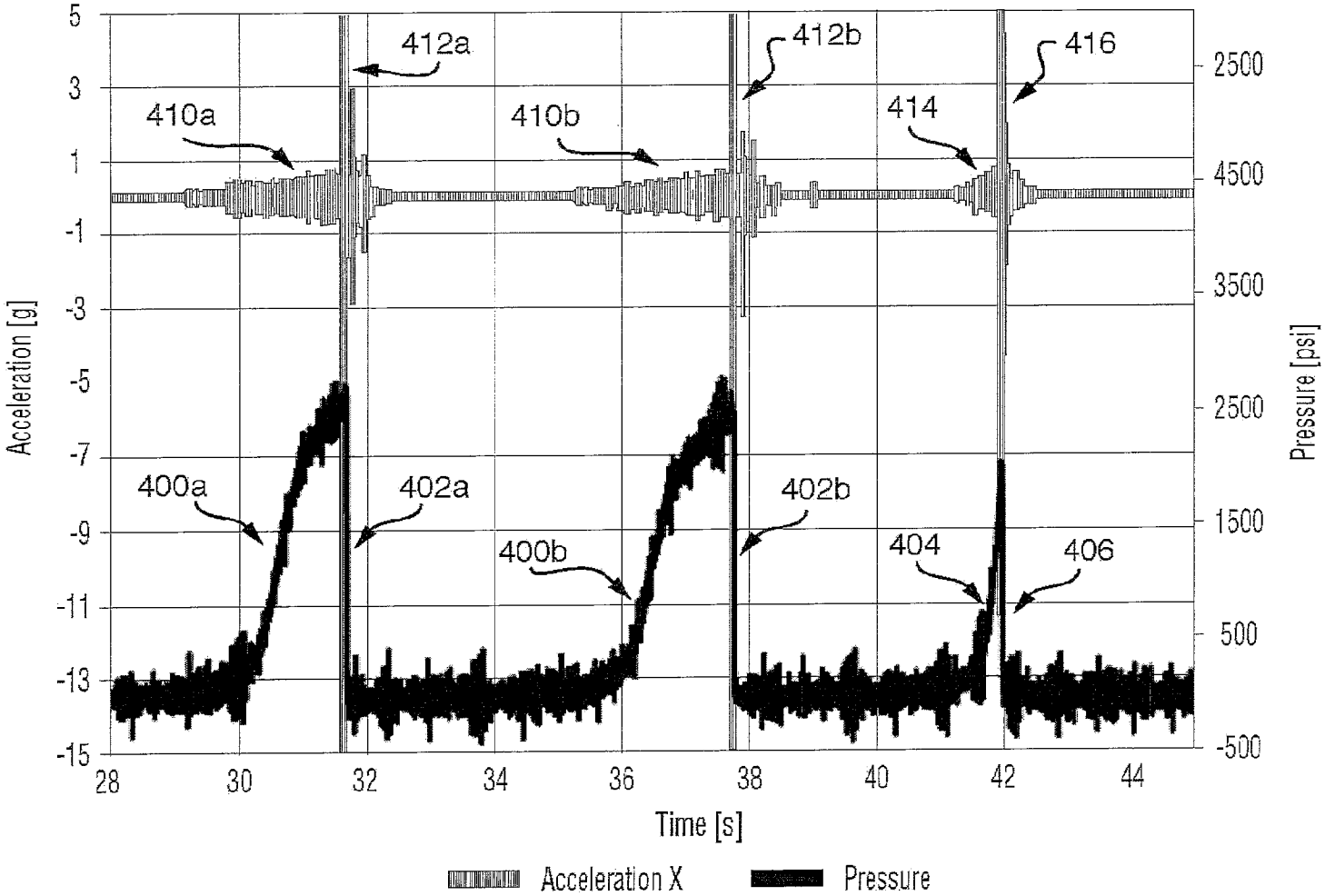

In FIG. 4*d*, the pressure signal and the vibration signal in the x-axis direction are plotted together in the same graph, showing the correlation between the two. The sequence of events in the test assembly indicated by the pressure signal corresponds very closely with those indicated by the vibration signal. For example, the rise in pressure 400*b* between 36 s and 38 s substantially coincide with the vibration signal 410*b*. Also, the pressure drop 402*b* near the 38 s mark substantially coincide with the vibration signal 412*b*, as expected since the passage of the ball through the sleeve in sub 160*b* and the slamming of the sliding sleeve against the shoulder in sub 160*b* happened almost simultaneously.

Figure 4E:
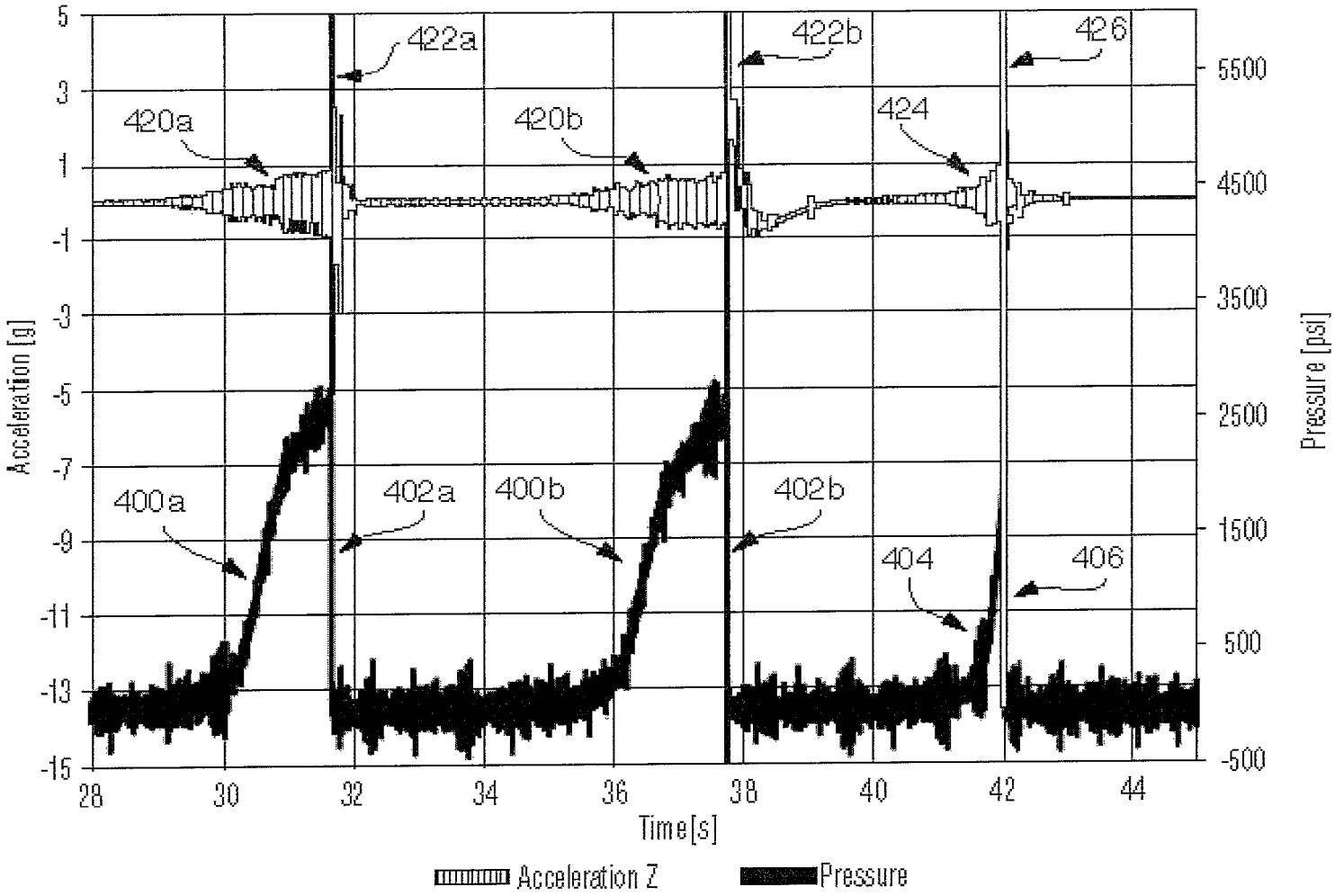

In FIG. 4*e*, the pressure signal and the vibration signal in the z-axis direction are plotted together in the same graph, showing the correlation between the two. The sequence of events in the test assembly indicated by the pressure signal corresponds very closely with those indicated by the vibration signal. For example, the rise in pressure 404 between 41 s and 42 s substantially coincide with the vibration signal 424. Also, the pressure drop 406 near the 42 s mark substantially coincide with the vibration signal 426, as expected since the opening of the port in sub 140 and the slamming of the sliding sleeve against the shoulder in sub 140 happened almost simultaneously.

FIGS. 5*a* to 5*c* are more detailed graphs showing the sequence of events with respect to only sub 140. FIG. 5*a* shows the pressure signal over time after the ball had pass through sub 160*b*. As shown in FIG. 5*a*, the rise in pressure 404 occurred between about 41.2 s and just before 42 s, and the drop in pressure 406 occurred immediately before 42 s. Referring to FIGS. 5*b* and 5*c*, the vibration signals 414 in the x-axis direction and 424 in the z-axis direction substantially coincide with a steeper part of the pressure rise 404 (i.e. between about 41.6 s and just before 42 s). The vibration signals 416 in the x-axis direction and 426 in the z-axis direction substantially coincide with the pressure drop 406 around the 42 s mark.

Therefore, analyzing vibration data may help determine the occurrence of certain events with respect to a downhole tool, for example confirming the arrival of a ball at a seat, the movement of a sleeve, including the stopping of the sleeve against a shoulder, which may include the opening of a port. Further, vibration data may be compared to pressure data to provide further confirmation of a downhole event, such as the passage of a ball through a constriction such as a pass-through sleeve, the opening of a port, etc. Further, vibration data may be compared against time to determine the speed of an actuation device moving through tubing.

Data was also collected from a test assembly in a field test. The data collected from the field test assembly is plotted in the graphs shown in FIG. 6. The field test assembly, which was similar to that shown in FIG. 1*a*, had twenty subs that were connected in series and separated by packers in the tubing string. The tubing string was situated underground and an upper end of the tubing string was connected to a wellhead at surface. A piezoresistive strain transducer and a triaxial integrated circuit piezoelectric (ICP) accelerometer were used to collect data. The accelerometer was mounted on the casing bowl of the wellhead. The transducer was mounted to a manifold on the main water line close to the wellhead. Pressure signals generated by the transducer and acceleration signals generated by the accelerometer were recorded with a data acquisition system consisting of analog current and voltage modules, pressure and acceleration power supplies and a computer with USB connection to the data acquisition system. $N_2$ was pumped down the field test assembly at a concentration of around 10-20% by volume. Twenty balls were dropped into the test assembly sequentially. The diameter of the balls ranged from about 1.5" to about 3.75".

FIG. 6 shows data relating to the actuation of the nineteenth sub of the field testing assembly having twenty subs. The twentieth sub in the test assembly was the closest to the wellbore opening at surface, while the nineteenth sub being further downhole than the twentieth sub was the second closest to the wellbore opening. The top graph in FIG. 6 shows acceleration data (sometimes also referred to as vibration data or acoustic data) in the x-axis, the middle graph shows acceleration data in the z-axis, and the bottom graph shows pressure data collected from the field test assembly. The pressure signal shown in FIG. 6 had been filtered with a low-pass Butterworth filter with a cut-off of 10 Hz. The acoustic signals in FIG. 6 had not been filtered.

A ball sized to pass through the twentieth sub and to actuate the nineteenth sub was launched through a buffalo head into the field test assembly and $N_2$ was pumped into the test assembly at around the 30 s mark. The injection of $N_2$ was indicated by a rise 500 in the pressure signal. The injection of $N_2$ was also indicated by spikes 600*a*, 600*b* in the acceleration signals (sometimes also referred to as vibration signals or acoustic signals) in the top and middle graphs, which coincide with the pressure rise 500. As the ball rolled down the test assembly towards the twentieth sub, the movement of the ball and its interaction with the interior of the test assembly generated vibrations, which appear in the acoustic signals as small spikes 602. As the ball passed through the seat of the twentieth sub, the flow path through the sub was constricted, causing the pressure to rise momentarily. This temporary constriction was indicated by a small peak 504 in the pressure signal and corresponding spikes 604*a*, 604*b* in the acoustic signals at about 1:05 s. The ball continued down the test assembly and reached the seat of the nineteenth sub. The impact of the ball on the seat caused a small rise in pressure, as indicated by a peak 506 in the pressure signal at around 1:30 s. The impact between the ball and the seat also caused vibrations in the test assembly, which were indicated by spikes 606*a* and 606*b* in the acoustic signals.

As the ball was pressed tighter into the seat of the nineteenth sub by the continuous supply of $N_2$ down the assembly, fluid pressure above the seat built up, which was represented by a rise 508 in the pressure signal between about 1:30 s and 2:42 s. As the ball was pressed into the seat, the physical interaction between the ball and the seat generated sounds (e.g. hissing and squealing), which were captured as increasing acoustic signals 608*a*, 608*b*. When the port of the nineteenth sub was opened at around 2:43 s, spikes 610*a*, 610*b* were seen in the acoustic signals, which resulted from the vibrations from the sliding sleeve of the nineteenth sub slamming into a shoulder in the sub after it was pushed into the port-open position. The opening of the port was also indicated by a slight dip 510 in the pressure signal. It can be seen that, in the field test, a pressure of approximately 2825 psi was required to shear the shear pin in the sub to open its port. In the field test, the fluid pressure in the test assembly continued to rise (and the acoustic signal continued to increase) after the opening of the port in the nineteenth sub, because the fluid and $N_2$ in the sub had to be further compressed in order to fracture the well. After this initial rise in pressure from the opening of the port, the pressure signal became substantially constant for a period of time 512 before rising again. The pressure at which the pressure signal was substantially constant indicates the breakdown pressure, which is the pressure required to fracture a formation. In the field test, the breakdown pressure at the nineteenth sub was about 5750 psi.

Therefore, acoustic data may be used to confirm the location and movement of an actuation device along a string, fluid pumping effects, and the occurrence of certain events with respect to a downhole tool, for example, opening of a sleeve, confirming the opening of a port, etc. Further, acoustic data may be compared to pressure data and/or time lapse to provide further confirmation of a downhole event.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

What is claimed is:

1. A well monitoring system, comprising:

a transducer mounted on a wellhead apparatus, configured to record sensed vibrations arising from an unknown downhole operation; and a processing system loaded with a first reference vibration signal generated from a previously identified first instance of a first known downhole operation, and a second reference vibration signal generated from a previously identified first instance of a second known downhole operation wherein the processing system is configured to, receive a sensed vibration signal generated from the sensed vibrations, generate a comparison of the sensed vibration signal with the first and second reference vibration signals, and, recognize the sensed vibrations arising from the unknown downhole operation as indicative of a second instance of either the first known downhole operation or the second known downhole operation, based on the comparison.

2. The well monitoring system of claim 1 wherein the transducer is an accelerometer.

3. The well monitoring system of claim 1 wherein the sensed vibration signal is an acoustic signal.

4. The well monitoring system of claim 1 wherein the processing system includes a filter.

5. The well monitoring system of claim 1, further comprising a data acquisition system for collecting the first and the second reference vibration signals.

6. The well monitoring system of claim 1, wherein the transducer is an electro-acoustic transducer.

7. The well monitoring system of claim 1, further comprising a second transducer.

8. The well monitoring system of claim 1, wherein the sensed vibrations are propagated in the well as acoustic vibrations.

9. The well monitoring system of claim 1, wherein the sensed vibrations are propagated in the well as mechanical vibrations.

10. The well monitoring system of claim 1 wherein the unknown downhole well operation is a device actuation.

11. The well monitoring system of claim 10 wherein the device actuation is movement of a sliding sleeve.

12. A method for monitoring downhole well operations, comprising:

recording, by a transducer mounted on a wellhead apparatus, sensed vibrations arising from unknown downhole well operations;

generating, by a processing system coupled to the transducer, a comparison of the sensed vibrations with a reference vibration signal generated from previously sensed vibrations arising from a previously identified first instance of a first known downhole well operation and a previously identified first instance of a second known downhole well operation, and recognizing the sensed vibrations as indicative of a second instance of either the first known downhole well operation or the second known downhole well operation, based on the comparison.

13. The method of claim 12 wherein the recent downhole well operation is a device actuation.

14. The method of claim 13 wherein the device actuation is any one of setting a packer, releasing a packer, opening a valve, or closing a valve.

15. The method of claim 12 wherein the sensed vibrations are sensed by a plurality of transducers.

16. The method of claim 15, wherein the transducers include an accelerometer.

17. The method of claim 15, wherein the transducers include a microphone.

18. The method of claim 12 further comprising collecting the reference vibration signals.

* * * * *